US011072141B1

(12) United States Patent
Frederick et al.

(10) Patent No.: US 11,072,141 B1
(45) Date of Patent: Jul. 27, 2021

(54) ROBOTIC CASE ERECTOR

(71) Applicant: Douglas Machine Inc., Alexandria, MN (US)

(72) Inventors: Aaron M. Frederick, Alexandria, MN (US); Grady J. Ries, Alexandria, MN (US); Richard W. Lukanen, Jr., Alexandria, MN (US); Christopher Todd Davis, Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 354 days.

(21) Appl. No.: 15/927,588

(22) Filed: Mar. 21, 2018

Related U.S. Application Data

(60) Provisional application No. 62/474,314, filed on Mar. 21, 2017.

(51) Int. Cl.

| | |
|---|---|
| ***B31B 50/00*** | (2017.01) |
| ***B31B 50/06*** | (2017.01) |
| ***B31B 50/26*** | (2017.01) |
| ***B31B 50/58*** | (2017.01) |
| *B31B 100/00* | (2017.01) |

(52) U.S. Cl.
CPC ..... *B31B 50/006* (2017.08); *B31B 50/06* (2017.08); *B31B 50/26* (2017.08); *B31B 50/58* (2017.08); *B31B 2100/00* (2017.08); *Y10S 901/16* (2013.01); *Y10S 901/32* (2013.01)

(58) Field of Classification Search
CPC ..... B31B 50/006; B31B 50/06; B31B 50/26; B31B 50/58; B31B 2100/00; Y10S 901/16; Y10S 901/32
USPC ..... 493/2, 309, 311, 310
See application file for complete search history.

(56) References Cited

U.S. PATENT DOCUMENTS

| | | | | |
|---|---|---|---|---|
| 5,024,640 | A * | 6/1991 | Saitoh | B31B 50/00 493/127 |
| 5,352,178 | A * | 10/1994 | Pazdernik | B65B 7/20 493/137 |
| 6,913,568 | B2 * | 7/2005 | Frank | B31B 50/80 493/309 |

(Continued)

FOREIGN PATENT DOCUMENTS

| | | |
|---|---|---|
| WO | 2017041007 | 3/2017 |
| WO | 2017147584 | 8/2017 |

*Primary Examiner* — Sameh Tawfik
(74) *Attorney, Agent, or Firm* — Dicke, Billig & Czaja, PLLC

(57) ABSTRACT

A case setup apparatus is generally provided. The apparatus is characterized by a robotic arm and a case engaging apparatus carried by the robotic arm. The case engaging apparatus is characterized by a picker arm assembly for picking a case blank from a source of case blanks, and a rack arm assembly for attaching to a picked case blank. The picker arm assembly is fixedly supported within the case engaging apparatus and the rack arm assembly is pivotably supported, relative to the picker arm assembly, within the case engaging apparatus. A flap folding subassembly is provided and translatably supported within the case engaging apparatus for reversible travel parallel to the picker arm assembly. The subassembly includes flap engaging members, a flap engaging member of the flap engaging members being forwardly extendable to disassociate adjacent flaps of a case blank in advance of folding a flap by the flap engaging members.

17 Claims, 7 Drawing Sheets

(56) References Cited

U.S. PATENT DOCUMENTS

| | | | | |
|---|---|---|---|---|
| 7,390,291 | B2 * | 6/2008 | Chiu Chen | B31B 50/00 493/313 |
| 7,585,265 | B2 * | 9/2009 | Gebhardt | 493/70 |
| 7,788,881 | B2 * | 9/2010 | Johnson | B65B 43/265 493/309 |
| 8,075,467 | B2 * | 12/2011 | Monti | B65B 43/305 493/309 |
| 8,128,547 | B2 * | 3/2012 | Graham | B31B 50/00 493/313 |
| 9,126,380 | B2 * | 9/2015 | Dittmer | B31B 50/00 |
| 9,486,972 | B2 * | 11/2016 | Mack | B65D 5/12 |
| 10,196,163 | B2 * | 2/2019 | Baltes | B65B 43/285 |
| 10,640,308 | B2 * | 5/2020 | Porteous | B65G 59/068 |
| 2004/0162207 | A1 * | 8/2004 | Ruf | B65B 43/185 493/309 |
| 2009/0239726 | A1 * | 9/2009 | Huang | B31B 50/00 493/309 |
| 2016/0185066 | A1 * | 6/2016 | Klein | B31B 50/00 493/125 |

* cited by examiner

BACKGROUND

ROBOTIC CASE ERECTOR

This is a United States national patent application filed pursuant to 35 USC § 111(a) claiming priority under 35 USC § 120 of/to U.S. Pat. Appl. Ser. No. 62/474,314 filed Mar. 21, 2017 and entitled ROBOTIC CASE ERECTOR (RCE), the disclosure of which is hereby incorporated by reference in its entirety.

TECHNICAL FIELD

The present invention generally relates to packaging equipment, more particularly, to automated case erecting and/or case erecting and forming, and more particularly still to a modular apparatus or assembly for setting up a case from a case blank.

BACKGROUND

Owing to numerous factors such as low cost, light weight and recyclability, cardboard boxes or cases are supremely convenient and thus ubiquitous. While cardboard cases have evolved, for instance, into transport, display and dispensing devices for articles packed therein, as is evidenced by walking the isles of many super stores or the like, the inherent nature of the case, exclusive of its highly variable configuration, nonetheless remains. More particularly, cardboard boxes or cases are commercially available, business-to-business, in a folded flat condition (i.e., a "flattened" or "knockdown" condition, akin to a flattened sleeve) as a blank, with manipulations (i.e., case setup) characterized by expansion and flap folding/tucking/sealing required to transform the blank into a case.

As to type, the most common cardboard box or case used in packaging/shipping is the Regular Slotted Case (RSC) owing to its cost effectiveness, and a variant thereof, a Half Slotted Case (HSC). The RSC is characterized by opposing major and opposing minor panels. Major and minor flaps extend or depend from each major and minor panel respectively. Moreover, the major flaps run the length of the box with the two minor flaps at each end. The major flaps overlie the folded minors, and meet in the center when folded. The HSC is characterized by an absence of flaps from a "top" or "bottom" of the case, i.e., the HSC is essentially an RSC without top flaps, this style oftentimes is combined with a lid during transport.

As to configuration, knockdowns or blanks are available in two configurations, namely left and right handed. The relationship between the major and minor panels of a knockdown case determine its "handedness," i.e., in elevation view, a minor panel adjacent to the right of the major panel (i.e., major panel "left") is a left hand configuration; a minor panel adjacent to the left (i.e., major panel "right") is a right hand configuration.

In keeping with Applicant's earlier work, namely, U.S. Pub. No. 2016/0185066 entitled Modular Case Erector, incorporated herein explicitly by reference in its entirety, a particularly instructive depiction with regard to cases/case formation is FIG. 14 of U.S. Pat. No. 7,390,291 (Chiu Chen), provided herein as FIG. 1, and labeled as "BACKGROUND." Each of the cases (C) is formed from a blank (B), more particularly, a left hand regular slotted case (LHRSC) blank as shown. While the case is characterized by opposing major and minor walls, $W_M$ and $W_m$ respectively, and opposing major and minor base portions, $B_M$ and $B_m$ respectively, each depending from opposing major and minor walls, $W_M$ and $W_m$ respectively, the blank is characterized by first and second panels, P1 & P2 respectively, each panel including major and minor panels $P_M$ and $P_m$, which correlate with/to major and minor case walls $W_M$ and $W_m$, with the panels of the blank further including major and minor flaps, $F_M$ and $F_m$ respectively, each extending from opposing sides of the major and minor panels $P_M$ and $P_m$ respectively. Major and minor flaps $F_M$ and $F_m$ of blank B correlate with/to opposing major and minor base portions $B_M$ and $B_m$ of case C.

There are many case erectors on the market today, with such assemblies commonly categorized according to processing rates, namely, low speed (<15 cases per minute (cpm), mid speed (15-30 cpm), high speed (30-70 cpm), and low speed robotic (<15 cpm).

Low speed case erectors are air cylinder driven machines that are typically running at a speed of not more than 15 cpm. These types of erectors are characterized by ac motor driven mechanisms with simple controls. These machines can be very effective for their low cost. Most of these case erectors are tape sealing machines (versus glue sealing) because of the low cost. While advantageous in relation to cost and operational ease, shortcomings include, but are not limited to, air cylinder noise and fast wear times, and a larger floor plan footprint with a case blank magazine commonly positioned 90 degrees to process flow.

Mid speed case erectors include more technology than their low speed counterparts, and thus carry a higher price tag. These types of erectors are likewise characterized by air cylinders, however, servos and linear actuators accompany them in order to obtain the higher throughputs. The control system of these machines typically reflect the types of devices used to drive them; PLCs as well as compact logics with touch screens are frequently provided. These machines are some of the most popular models due to attainable throughput as well as the options of both tape and glue sealing systems that can be operatively linked to them. While advantageous in relation to cost and an in-line floor plan footprint, shortcomings include, but are not limited to, air cylinder noise and fast wear times, and a throughput ceiling of 30 cpm.

High speed non-robotic case erectors are characteristically very large and expensive. These types of erectors are fully driven by servos, and utilize complete machine control systems. They do not have any air cylinders, and only contemplate/include glue sealing systems. These machines seem to be the least prevalent of the four types, mostly due to size, cost and limited amount of loading equipment that can keep up with them. They typically feed multiple packaging lines. While advantageous in relation to processing speed and configuration (i.e., in-line), shortcomings include, but are not limited to, high cost, large floor plan footprint and glue only sealing.

Finally, low speed robotic case erectors are commonly characterized by one or two third party six axis robots, each robot equipped with a complex pick head, that picks blanks from/out of a fixed magazine of case blanks, and an end effector for setting up the case. A stationary device is commonly used to fold and plow all flaps in advance of sealing, the set up case being driven there through or thereby. The control system of these machines is typically an amalgam of the third party robotic controller (i.e., the controls part and parcel of the purchased robot) as well as a secondary system to run guard doors and any conveyors, photo eyes, etc. present in the system or assembly. These machines are slower, <15 cpm, due to the large travel distances for the robot: from the magazine to the flap folding device, and then to and through the sealer. While advantageous in relation to processing speed, repeatability and flexibility, shortcomings include, but are not limited to, high cost, large floor plan footprint, controller challenges vis-à-vis compatibility and relatively low speed.

In light of the state of affairs, it remains advantageous and desirable to provide a cost effective, reliable mid to high speed case erector. Moreover, it is believed advantageous to greatly reduce or even minimize a working volume for case setup operations, and/or to reduce or even eliminate "hand-offs" of a case blank undergoing setup operations (i.e., transfers in/about the case setup station). Further still, improved flap tucking, e.g., swift and reliable flap tucking, remains a shortcoming relative to fast repeatable throughputs.

SUMMARY OF THE INVENTION

A case setup apparatus is generally provided, as are case setup operations. The apparatus is characterized by a robotic arm and a case engaging apparatus carried by the robotic arm. The contemplated apparatus advantageously operates so as to set up cases at a rate of up to about 30 cpm, with cases for setup characterized by dimensions within a range of about 9.5-19 inches in length, 6-16 inches in height, and 5.5-16 inches in width.

The case engaging apparatus is characterized by a picker arm assembly for picking a case blank from a source of case blanks, and a rack arm assembly for attaching to a picked case blank. The picker arm assembly is fixedly supported within the case engaging apparatus and the rack arm assembly is pivotably supported, relative to the picker arm assembly, within the case engaging apparatus. A flap folding subassembly is provided, and translatably supported within the case engaging apparatus for reversible travel parallel to the picker arm assembly. The subassembly includes flap engaging members, a flap engaging member of the flap engaging members being forwardly extendable to disassociate adjacent flaps of a case blank in advance of folding a flap by the flap engaging members.

Advantageously, the case engaging apparatus is carried by the robotic arm for two dimensional travel, more particularly, the case engaging apparatus travels in a processing flow direction, and in a direction transverse to process flow. Further still, the case engaging apparatus is carried by the robotic arm for rotation in addition to two dimensional travel. An advantageous, non-limiting configuration has the robotic arm overlying a working volume/residing in a horizontal plane in a case setup station, the case engaging apparatus downwardly extending therefrom. Moreover, advantageously, but not necessarily, the robotic arm comprises a selective compliance robot arm (SCARA).

The flap folding apparatus, in the contemplated context a flap folding subassembly, preferably, but not necessarily depends or is otherwise subordinate to the picker arm assembly. An actuator is operatively linked, or more generally, associated with the forwardly extendable flap engaging member to reversibly extend same. Preferably, but not necessarily, at least one flap engaging member may be adjustably provided, relative to the one or more other flap engaging members, in the apparatus/subassembly in furtherance of establishing selective spaced apart relationships for, between and among the members. Moreover, it is believed advantageous to locate the forwardly extendable flap engaging member adjacent one other flap engaging member, and, further still, it is believed especially advantageous to locate the forwardly extendable flap engaging member intermediate adjacent flap engaging members of the flap engaging members.

The case engaging apparatus may be further and fairly characterized by cooperatively united plates, the picker arm assembly depending from a first plate of the cooperatively united plates, the rack arm assembly depending from a second plate of the cooperatively united plates, the cooperatively united plates delimiting a centerless pivot locus for the case engaging apparatus, the second plate driven for rotation relative to the first plate. Moreover, the plates have mating surfaces, one surface characterized by a track, the other surface characterized by track followers, their engagement delimiting the cooperative union.

Finally, as to the case set up apparatus, provisions are made for, for example, a support member uniting the robotic arm with the case engaging apparatus, and an actuator, more particularly a rack arm to effectuate pivot motion of the rack arm relative to the picker arm. A further picker arm is likewise contemplated, e.g., an "upper" picker arm for select position on the support member and in relation to the picker arm assembly.

As to case setup operations, more particularly, case setup from a case blank, a first preferred non-limiting method contemplates securing a case blank from a supply of case blanks using a picker arm of a case engaging assembly, a portion of the picker arm attaching to a first portion of the case blank. A rack arm of the case engaging assembly is directed toward the secured case blank via a pivot motion. A portion of the rack arm is attached to a second portion of the case blank, the second portion adjacent the first portion. The rack arm of the case engaging assembly is retracted in furtherance of setting up a squared case and, a first flap engaging member of the case engaging apparatus is extended to disassociate a flap depending from the second portion of the case blank from an adjacent flap depending from either the first portion of the case blank or a third portion of the case blank, the third portion opposite the first portion, in advance of commencing flap folding operations.

A second preferred non-limiting method contemplates providing a case setup apparatus characterized by a case engaging apparatus, a selective compliance robot arm, and a controller, the case engaging apparatus operatively carried for select two dimensional travel and select rotation in respect of a working volume of a case setup station by the selective compliance robot arm, a travel path for the select two dimensional travel for the case engaging apparatus predicated upon control of the selective compliance robot arm by said controller. Case length, width and height values are input to the controller, the travel path for the select two dimensional travel for the case engaging apparatus thereby established. The case setup apparatus is thereafter animated such that the case engaging member travels along the established travel path. The case engaging apparatus is selectively rotated in furtherance of picking a case from a supply of case blanks, and a portion of the case engaging apparatus being selectively rotated, while selectively rotating the case engaging apparatus, in furtherance of racking open a picked case from the supply of case blanks. More specific features and advantages obtained in view of those features will become apparent with reference to the drawing figures and DETAILED DESCRIPTION OF THE PREFERRED EMBODIMENTS.

BRIEF DESCRIPTION OF THE DRAWINGS

Various other objects, features and attendant advantages of the contemplated robotic case erector will become fully appreciated and/or better understood when considered in conjunction with the accompanying drawings, namely FIGS. 1-7 and particularly FIGS. 2-7, in which like reference characters designate the same or similar parts throughout the several views, and wherein.

DESCRIPTION OF PREFERRED EMBODIMENTS

In advance of taking up a description of preferred embodiments and drawing particulars, several preliminary observations are offered to facilitate an understanding of the scope and emphasis of the instant disclosure, and its organization. In-as-much as particular attention is directed to specific functions part-and-parcel of case setup and sealing operations, a brief overview of top load case packing operations immediately follows, with an overview of the instant description following thereafter.

Figure 1:
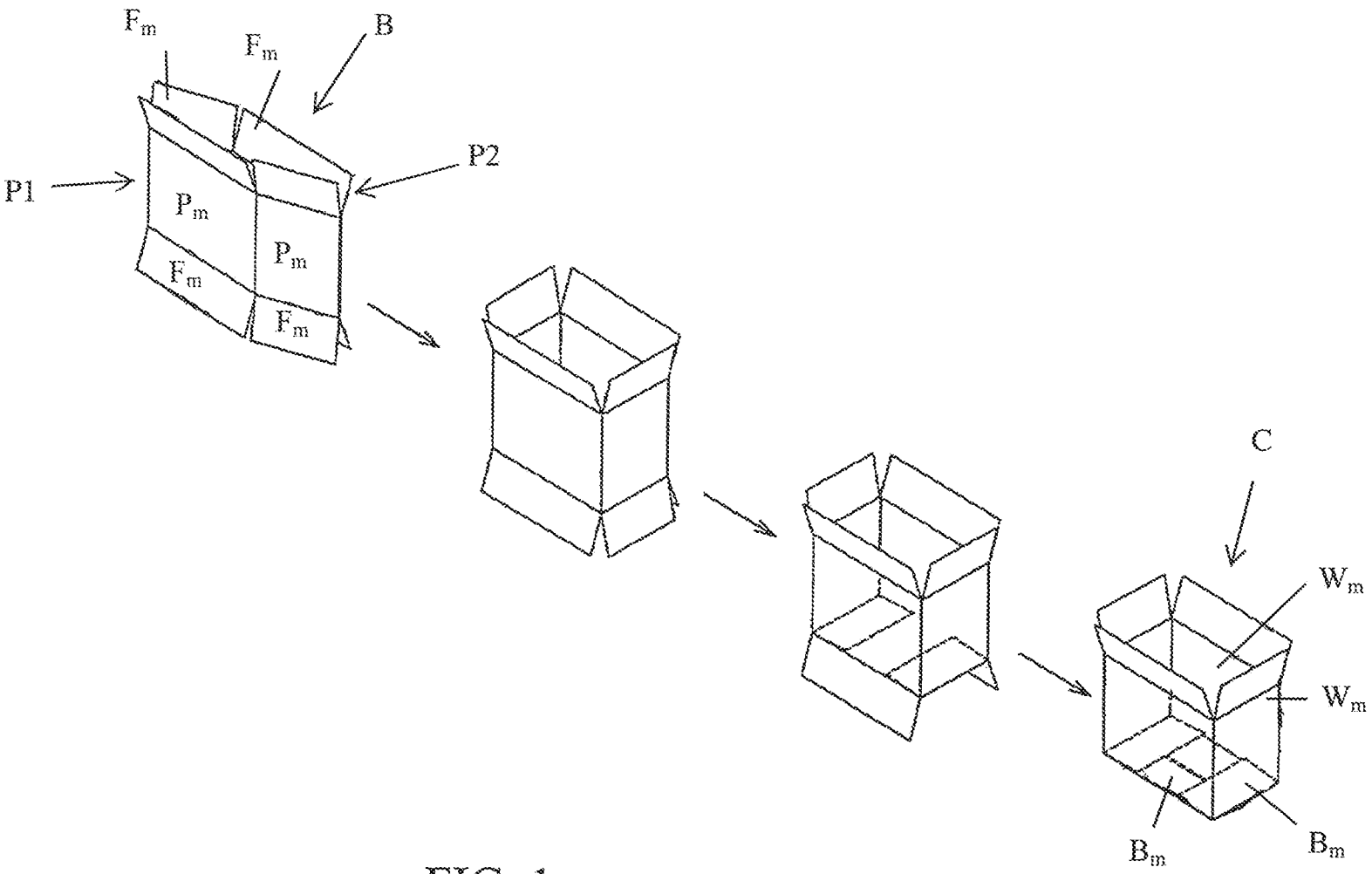
FIG. 1 illustrates, figure left to right, a typical case or box erecting and flap folding process, more particularly, such process as applied to a Regular Slotted Case (RSC), more particularly, to a left handed RSC (i.e., LHRSC)

Generally, a supply of case blanks are provided in the form of a magazine, the magazine being selectively loadable by an operator. As was discussed in the background, and as will be later taken up, case type and case orientation are important variables, deterministic of mechanized erection solutions. A blank of the magazine is operated upon in furtherance of expanding same, i.e., the opposing sides or panels of the blank (i.e., P1, P2, of blank B (FIG. 1)) are pulled apart, with minor flaps initially folded, folded/tucked and major flaps thereafter folded, folded/tucked in furtherance of forming a case "bottom" (FIG. 1). Sealing operations are executed on a partially formed or fully formed case so as to unitingly secure the folded flaps to each other via a taping or gluing step during case formation, or securing exterior flaps of the case bottom to each other and the case sidewalls or panels from which the tucked under flaps depend. Thereafter, the formed and securingly united case is commonly top loaded, with the flaps of the case "top" subsequently operated upon in furtherance of securingly united closure.

The subject description next proceeds in connection to the representative, non-limiting depictions of FIGS. 2-7, an overview of same provided prior to particulars. A case forming line or system is generally depicted FIG. 2, a contemplated non-limiting case setup apparatus characteristic thereof. A preferred, non-limiting case engaging assembly or apparatus is generally depicted FIG. 3 & FIG. 7, an operative combination of picker and rack arm assemblies thereof depicted FIG. 4. Finally, each of the picker and rack arm assemblies are separately depicted in FIGS. 5 & 6 respectively.

Figure 2:
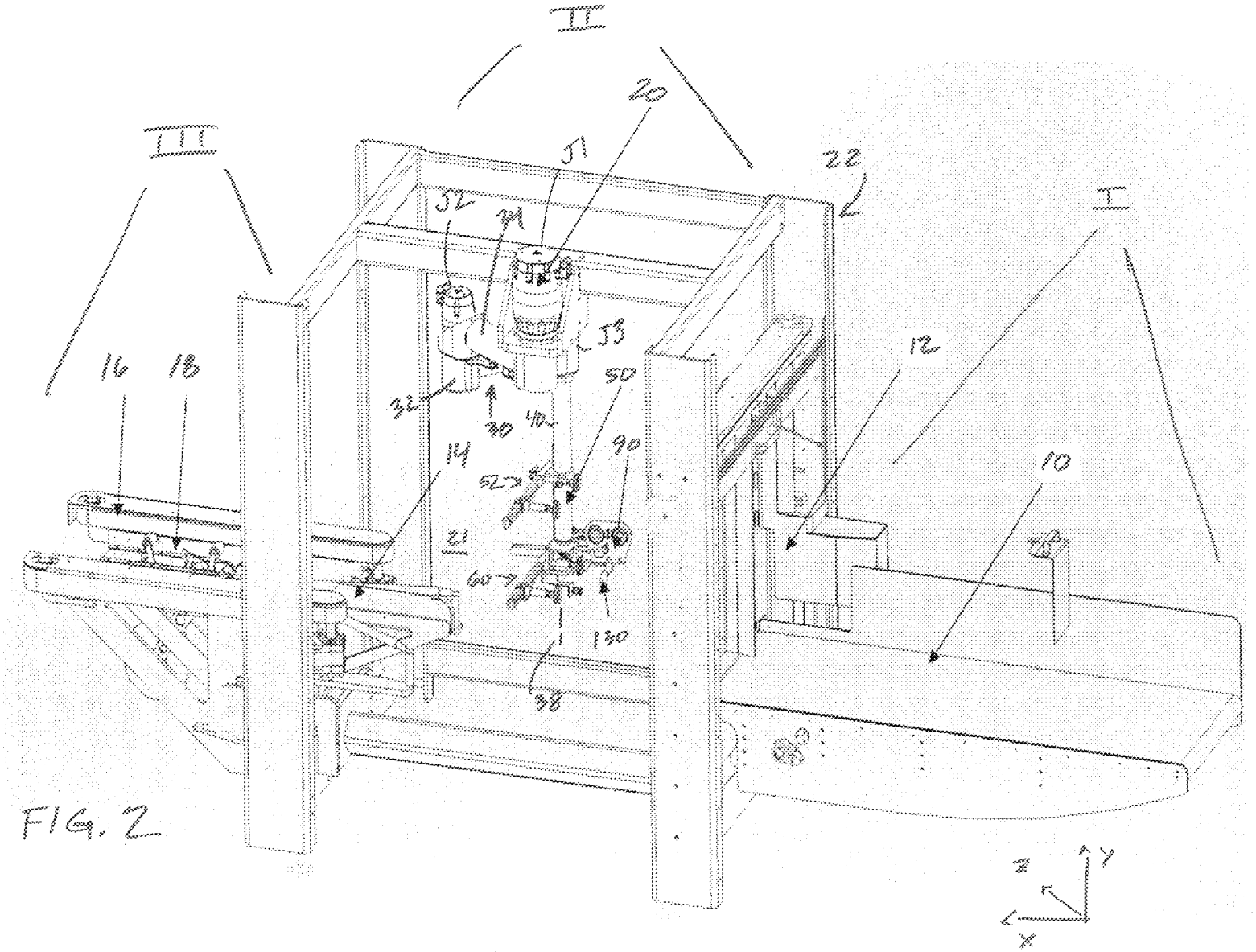
FIG. 2 depicts a non-limiting case forming line or system, isometric side view, characterized by a case setup station intermediate a case blank supply station and a case sealing station, process flow right to left.

With reference now to FIG. 2, a case forming line or system is generally depicted, process or operational flow figure right to left (i.e., x direction of the indicated coordinate system), a case setup station II shown intermediate a case blank supply station I and a case sealing station III. While a linear arrangement of the stations is depicted, it need not be so limited. For example, the case forming line may be characterized by a "right angle" relation for and between the supply and set up stations (x-z, or x-y). Moreover, and as will later be detailed, while a case setup apparatus 20 is shown in an "overhead" anchored orientation (x-z operations), it need not be so limited, with "side" anchored orientation (x-y operations) likewise contemplated. Brief descriptions of stations I & III immediately follow in advance of a description and discussion of the contemplated case setup apparatus of station II.

Case blank supply station I includes a case blank magazine 10. While a powered magazine is shown, it need not be so limited, e.g., gravity or other known or emerging means of feeding a case blank from a supply of case blanks may be suitably utilized or adapted for utilization. The case blanks are pushed up to or fed by the powered magazine to pick area 12 of station I, clips or other means are used to support the blanks to be consistently picked by case setup apparatus 20.

Case sealing station III receives a setup case from the apparatus of case setup station II in furtherance of effectuating sealed flap closure (i.e., sealing or uniting case major base portions $B_M$ in relation to case minor base portions $B_m$ (FIG. 1)). Generally, the setup case is advanced into a leading plow and major flap folder 14 to complete the case erection (i.e., fold the bottom case blank flaps and thereby establish the case base). Thereafter, the erected case is advanced to spring loaded side belts 16 and operated upon by a tape sealer 18, or alternately, stopped and sealed by gluing via a vertical mandrel/gluing assembly (not shown), an alternate/optional subassembly for the taper.

Case setup station II is characterized by case setup apparatus 20 which operates within a working envelope or volume 21 delimited by a substantial portion of the x-y-z space intermediate the supply and sealing stations, more particularly, the volume delimited by the structural framework 22 of setup station II as shown. Case setup apparatus 20 is fairly and notionally characterized by a robotic arm 30 from which depends, as by a structural element or support member 40, a case or case blank engaging apparatus 50.

The robotic arm is advantageously, but not necessarily, a selective compliance assembly robot arm (SCARA), a robotic arm have a characteristic two-degrees of freedom or axes and thus an ability to reach any point in a plane (i.e., 2D space, with the orientation as show, x-z space). As is generally well known, see e.g., Applicant's earlier work WO 2017/041007 entitled Improved Robotic Article Handling System & Operation, incorporated herein by reference in its entirety, a SCARA is characterized by first and second arm segments and three pivotable arm joints, a first arm joint J1 (i.e., a "shoulder") being an anchorable arm joint, a second arm joint J2 (i.e., an "elbow") being an intermediate arm joint, and a third arm joint J3 (i.e., a wrist) being a distal arm joint for operatively supporting an end effector (i.e., a "tool"), more particularly, case engaging apparatus 50 as shown, motion (rotary) at each joint effectuated by a servo 32. First and second arm segments link J1 & J2, and J2 & J3, colloquially, upper and lower arm segments 34, 36.

The robotic arm is supported over or above the working volume via a portion of the setup station framework as generally shown, at its shoulder, upper arm segment 34 extending toward the FIG. 2 viewer (i.e., −z direction). Thus, via quick, precise, repeatable and readily altered motion profiles, case engaging apparatus 50 is driven in 2D space (e.g., x-z space as shown), with the assembly pivotable or rotatable relative to an axial centerline 38 associated with joint J3 of robotic arm 30, and case assembly support member 40, in furtherance of case setup. The blanks of the depicted supply station are supplied so as to extend in a transverse machine direction (i.e., in a z-direction), with a setup case transferred to the sealing station having been rotated generally 90 degrees by the case engaging apparatus, as will be later appreciated as the instant disclosure proceeds, a first subassembly of subassemblies of the case engaging apparatus (i.e., a picker arm subassembly 60) picks a case blank from the source of case blanks via attachment to a major case panel ($P_M$) and thereafter retracts to a downstream local clear of the magazine whereupon a second subassembly of subassemblies of the case engaging apparatus (i.e., a rack arm subassembly 90) is actuated for pivot travel, through an angular range of up to about 120 degrees, relative to picker arm assembly 60 so as to attach to a minor case panel $P_m$ during rotation of case engaging apparatus 50, the case being appreciably setup by the coordinated motions of robotic arm 30 and case engaging apparatus 50.

Figure 3:
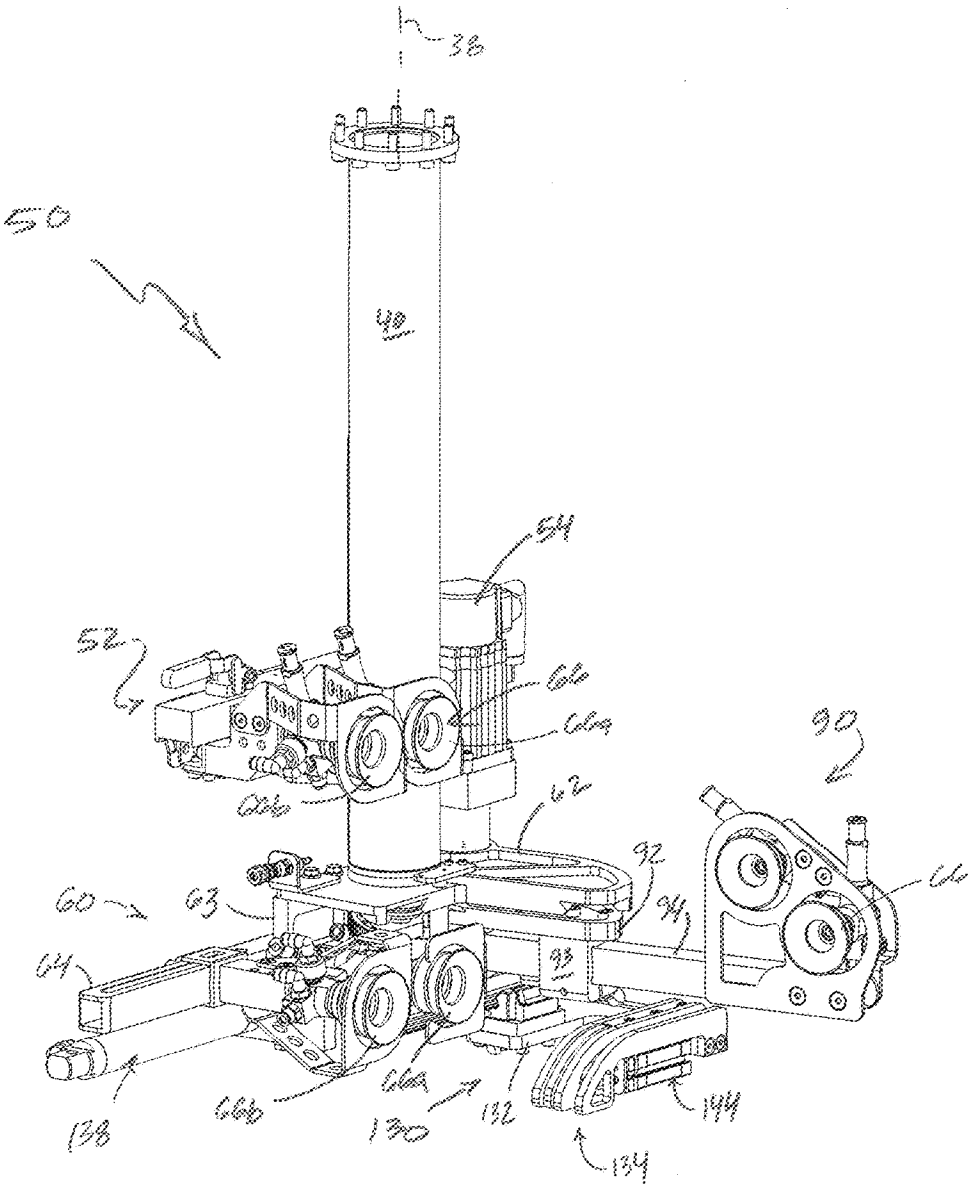
FIG. 3 depicts, isometric side view, a preferred, non-limiting case engaging apparatus not inconsistent with a case setup apparatus of the case setup station of FIG. 2.

Referring now to FIG. 3, there is generally shown a preferred, non-limiting case engaging assembly not inconsistent with a case setup apparatus of the case setup station of FIG. 2. Advantageously, case engaging assembly is characterized by a picker arm assembly 60, a rack arm assembly 90, and a flap folding subassembly 130, preferably subordinate to picker arm assembly 60 (see/note FIGS. 5 & 7). A further picker arm 52 is advantageously but not necessarily provided, colloquially, an "upper" picker arm. Moreover, a rack driver is provided, more particularly a rack arm assembly driver, advantageously but not necessarily in the form of a servo 54 as shown which operatively engages rack arm assembly 90 to effectuate pivot motion thereof.

As is shown FIG. 3, and especially appreciated with reference to FIGS. 5 & 6 and later detailed with respect thereto, picker and rack arm assemblies 60, 90 are operably united via plates, namely, a fixed "picker" plate 62 from which a picker arm 64 extends, and a pivotable "rack" plate 92 from which a rack arm 94 extends. The operably united or combined picker and rack arm assemblies 60, 90, and upper picker arm 52, are each supported (e.g., attached) to support member 40, the united assembly via picker arm plate 62 at a "free" end of support member 40, upper picker arm 52 via a collar or the like (not shown) which circumscribes support member 40, the attachment point, and thus distance between the picker arms, being a function of blank/case height.

Figure 4:
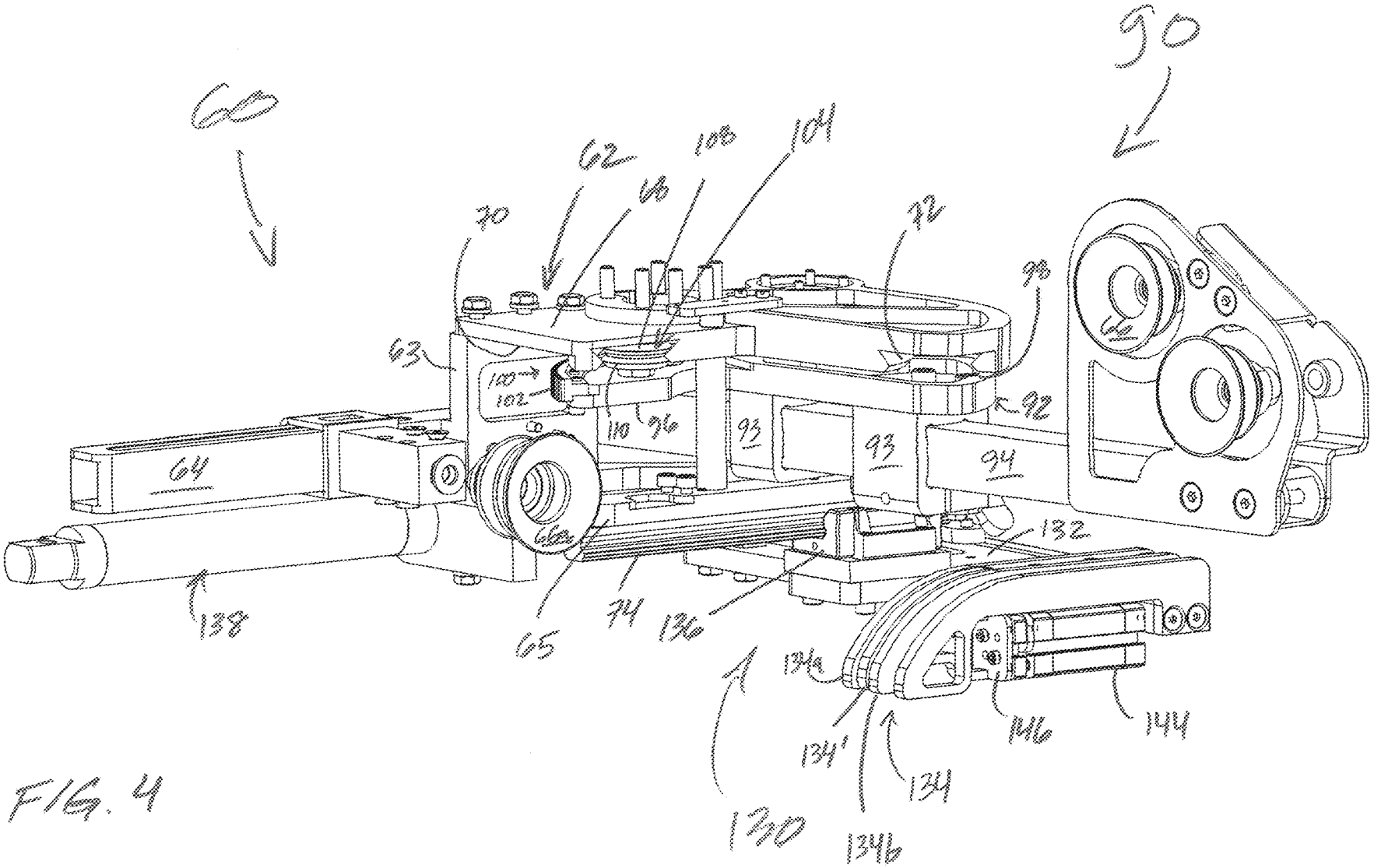
FIG. 4 depicts, select parts removed, picker and rack arm assemblies of the FIG. 3 case engaging apparatus in operative combination, including a flap folding subassembly.

With general reference to FIG. 4, there is generally shown an operative combination of picker and rack arm assemblies 60, 90. Particulars for the rack arm assembly follow particulars for the picker arm assembly and flap folding subassembly.

Figure 5:
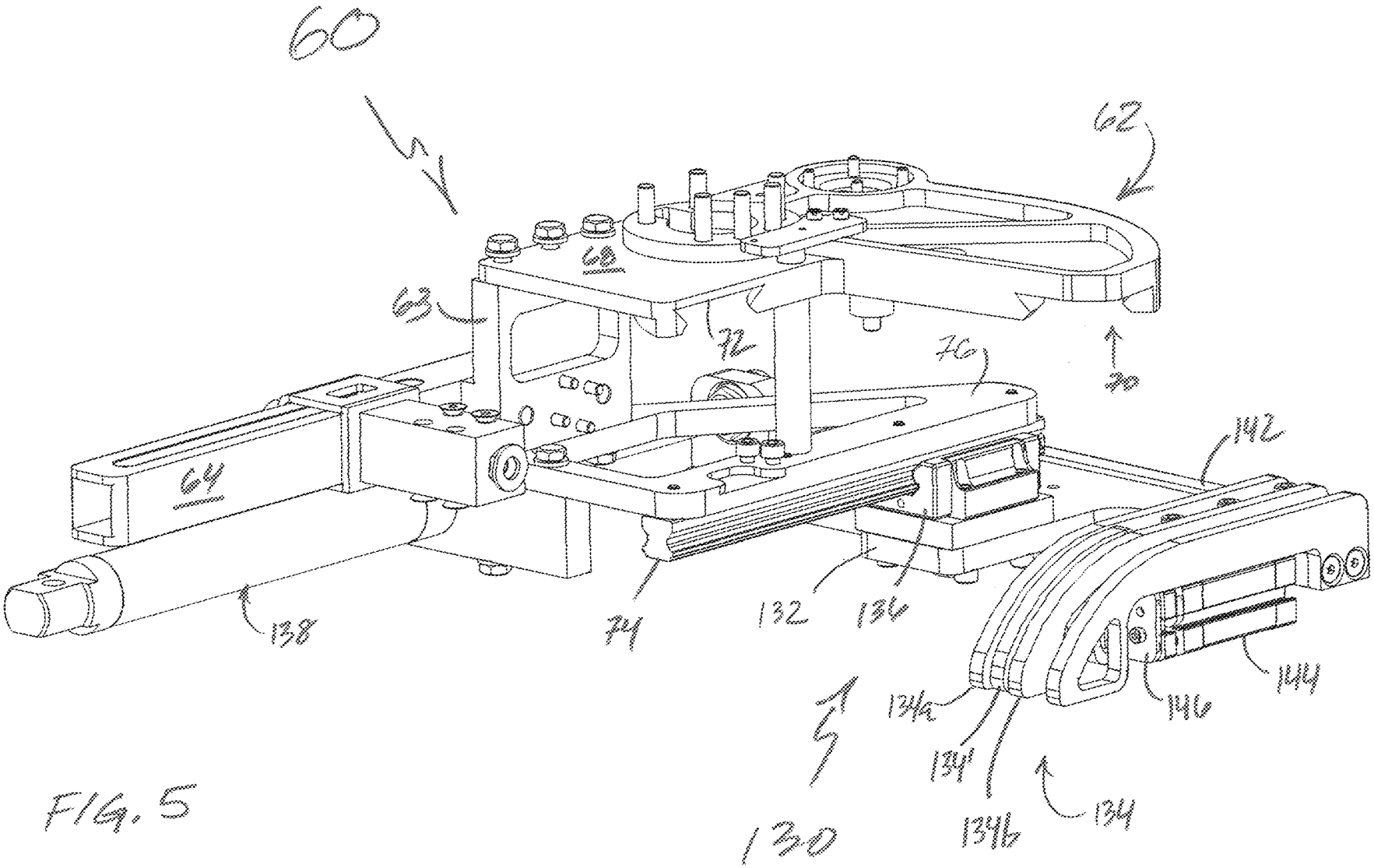
FIG. 5 depicts, select parts removed, the picker arm assembly of the FIG. 4 combination, the flap folding subassembly supported thereby.

Picker arm assembly 60, in operative combination with flap folding subassembly 130, is best seen and appreciated with continued reference to FIG. 4, and particular reference to FIG. 5. The instant assembly is advantageously characterized by picker arm 64 depending from picker plate 62. As shown, picker arm 64 and picker plate 62 are united via a bracket or framing element 63. Picker arm 64 conventionally supports means for securing a portion of the case blank (i.e., attaching the blank to the arm), for example, via vacuum cups 66 so as to apply a vacuum, via e.g., a venturi style vacuum system (not shown), to a portion of the case blank (i.e., major panel $P_M$ of the case blank). Preferably, but not necessarily, a proximal vacuum cup 66*a* is fixedly carried upon picker arm 64, a distal cup 66*b* selectively positionable along a length of arm 64, and reversibly affixable thereto, so as to set an advantageous spaced apart condition for the vacuum cups relative to the width of the major panel $P_M$ of the case blank. It should be readily appreciated that such arrangement for, among, and between the stated elements likewise apply to the upper picker arm.

Picker plate 62 includes opposing surfaces, namely, an upper surface 68 adapted to receive the free end of case engaging apparatus support member 40 and to receive an actuator or driver (e.g., servo 54, FIG. 3) to effectuate pivoting of rack arm 94 relative to picker arm 64 (or arms 52, 64), and a lower surface 70 adapted to operatively receive rack plate 92. Lower picker plate surface 70 includes an arcuately extending channel 72 (e.g., a keyway or track), more particularly a semi-circular keyway segment. More particularly still, and as shown, the keyway advantageously, but not necessarily, is characterized by a trapezoidal section. The keyway delimits a centerless pivot for case setup operations, the virtual circle center being an advantageous and preferred locus for positioning an edge of the case blank, namely the free edge of the major panel of a LHRSC, such that case squaring is enhanced during set up operations. Moreover, select squareness adjustment is effectuated via the centerless pivot design in combination with servo driven racking via the rack arm assembly.

Further part-and-parcel of picker arm assembly 60, preferably but not necessarily, is the contemplated and advantageous flap folding subassembly 130. As best seen with reference to FIGS. 5 & 7, flap folding subassembly 130 is generally characterized by a frame 132 and flap engaging members 134. Flap folding subassembly 130 is carriage-like in that frame 132 includes a track guide 136 for translating engagement upon a track section 74 carried by a structural element 76 of picker arm assembly 60. In addition to uniting picker arm 64 to/with picker plate 62, a framing element 65 unites flap folding assembly 130 to/with picker arm assembly 60. An actuator, advantageously in the form of a pneumatic cylinder 138 as shown, links the assembly and subassembly, flap folding subassembly 130 generally shown in a "home" position relative to picker arm assembly 60, a pneumatic cylinder rod 140 in extension, flap folding subassembly 130 generally positioned to underlie rack arm assembly 90, flap engaging members 134 supported on flap folding subassembly frame 132 so as to be substantially parallel to picker arm 64 of picker arm assembly 60 (FIG. 7).

In connection to flap breaking and folding, some preliminary comments are worthwhile. As best appreciated with renewed reference to FIG. 1, the flaps depending from the major and minor panels of the case blank are delimited by a score or perforation line (i.e., material has not been removed). During setup operations, the otherwise united flaps must be disassociated to aid squaring operations and enable meaningful flap folding. Notionally, via the instant flap folding subassembly, a flap engaging member of at least a pair of flap engaging members is selectively actuatable so as to extend forward of the one or more other flap engaging members so as to initially engage the minor flap and thereby separate the minor flap from the major flap in advance of subsequent flap folding operation.

Figure 7:
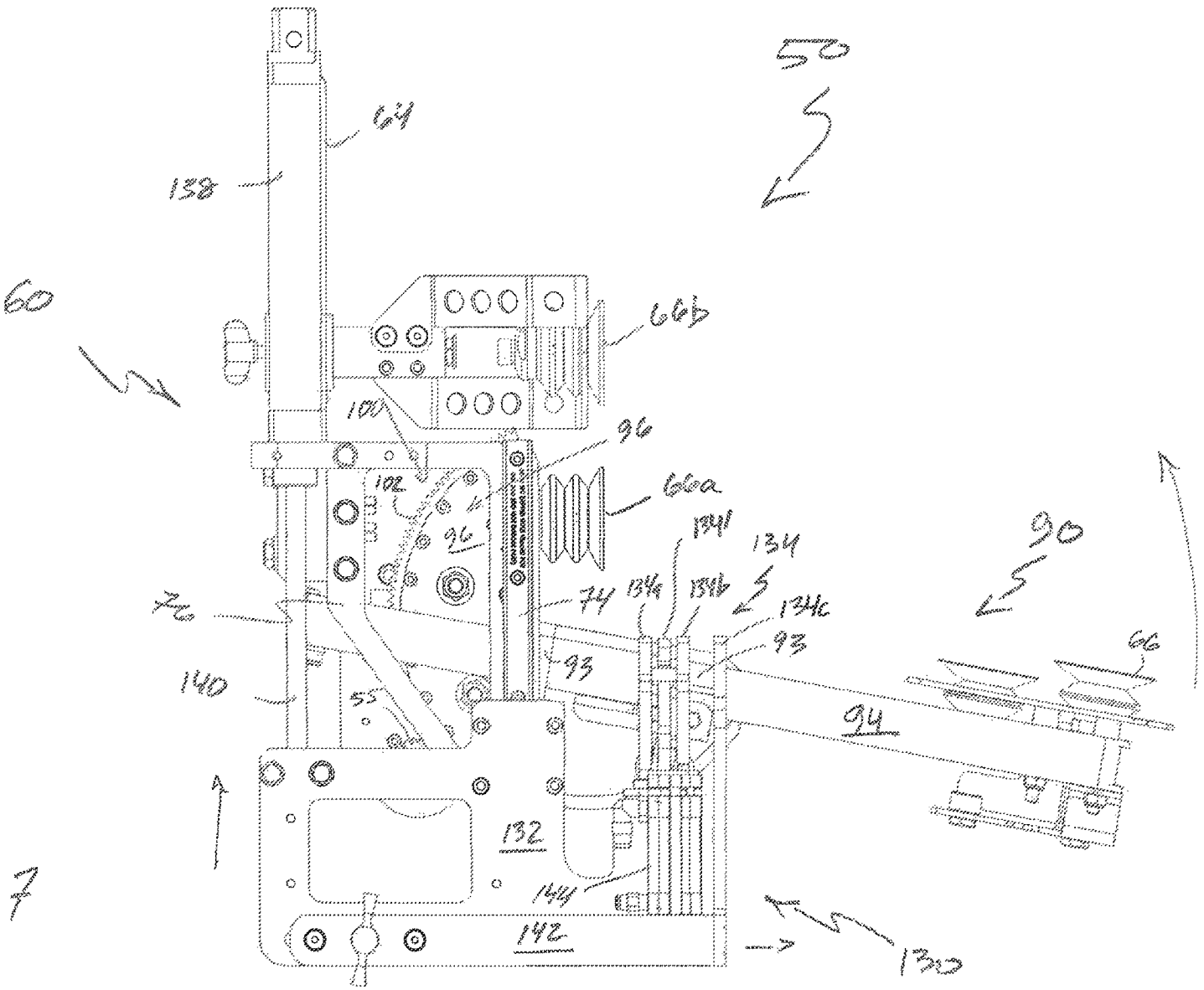

With continued reference to FIGS. 5 & 7, and as was earlier noted, flap folding subassembly frame 132 is equipped with flap engaging members 134, more particularly, advantageously but not necessarily, four minor flap engaging "fingers" as shown. In the context of a "wide" flap, as more than one minor flap engaging area is desirably targeted by the flap engaging members so as to effectuate a uniform or more uniform fold, at least one flap engaging member (i.e., a distal member 134*c*) is adjustable relative to the others (i.e., proximal and intermediate members, 134*a*, 134*b* as shown) so as to create a spaced apart condition for engagement across the width of the minor flap. As best appreciated with reference to FIG. 7, the right-hand most flap engaging member is carried upon a support bar 142 or the like which is translatable, relative to subassembly frame 132, away from picker arm 64, a "home" position for the distal flap engaging member illustrated (i.e., a width between proximal and distal members being a minimum). With such arrangement, opposing side portions of the minor flap may be selectively engaged in furtherance of a distributed or less focused application of flap folding pressure and thus a uniform or more uniform fold.

As was earlier detailed, all flap engaging members, owing to being supported upon a translatable carriage, reversibly travel in unison, in a direction parallel to the picker arm, toward a flap depending from the case blank panel secured to the rack arm. That said, a flap engaging member of the proximal flap engaging members is adapted so as to be forwardly extendable to disassociate adjacent flaps of a case blank in advance of folding a flap, namely the minor flap, by the flap engaging members. More particularly, an extendable flap engaging member 134' is intermediate a pair of fixedly supported flap engaging members 134*a*, 134*b*, extendable flap engaging member 134' operatively supported in the subassembly via a linear actuator, e.g., a pneumatic actuator 144 as shown. Linear actuator 144 is supported by/at subassembly frame 132, extendable flap engaging member 134' cooperatively linked to a portion of linear actuator 144 via a plate 146, actuator 144 in a fully retracted state as shown.

Figure 6:
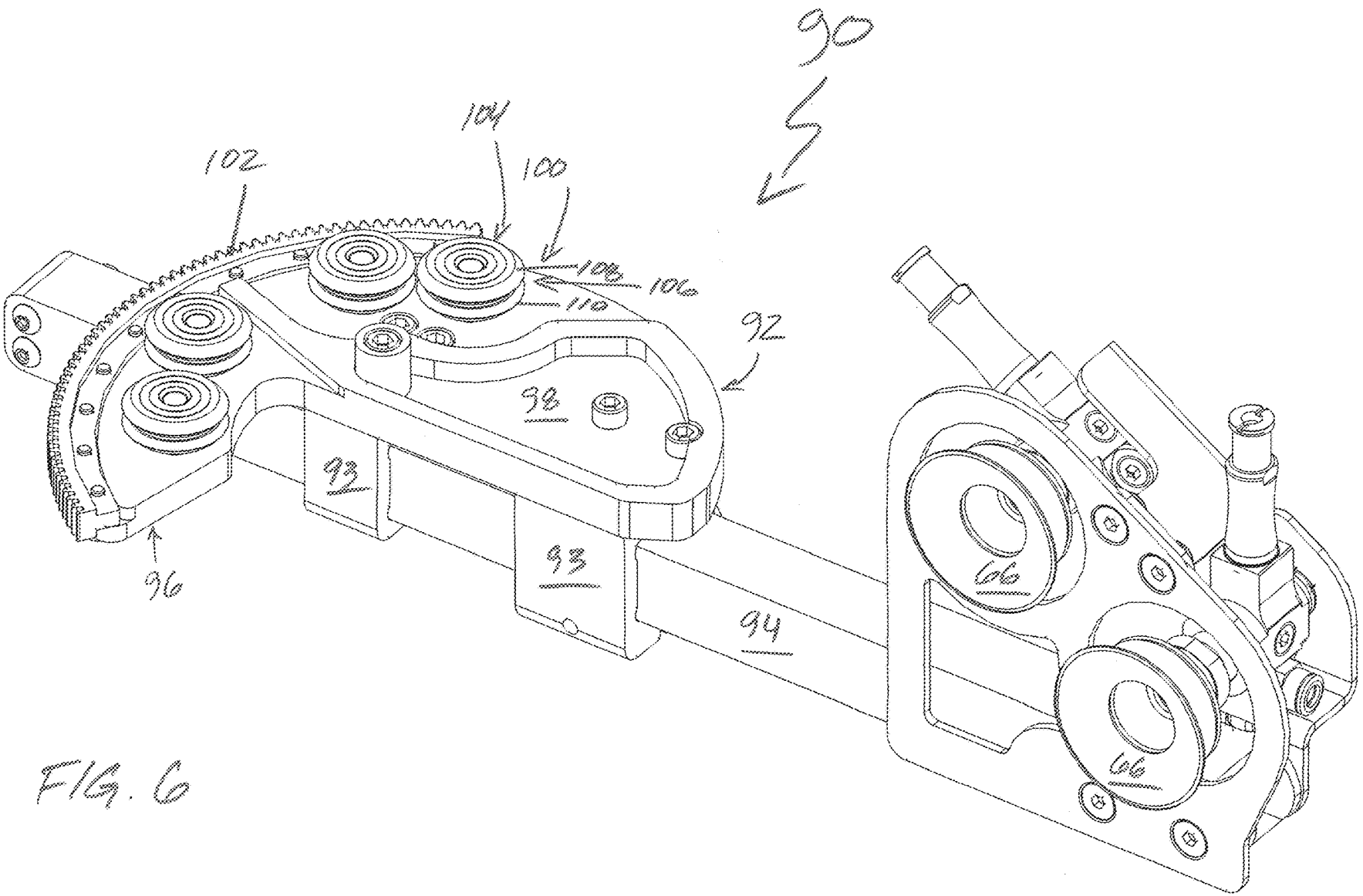
FIG. 6 depicts, select parts removed, the rack arm assembly of the FIG. 4 combination; and, FIG. 7 depicts, underside plan view select parts removed, the case engaging apparatus of FIG. 3.

With reference now to FIG. 6, particulars of rack arm assembly 90 of the combination of FIG. 4 are generally shown. The instant assembly is advantageously characterized by rack arm 94 depending from rack plate 92, rack arm 94 conventionally supporting means for securing a portion of the case blank (i.e., attaching the blank to the arm), for example, via vacuum cups 66 so as to apply a vacuum, via e.g., a venturi style vacuum system (not shown), to a portion of the case blank (i.e., a minor panel $P_m$ of the case blank). As shown, rack arm 94 and rack plate 92 are united by brackets 93 or the like, rack arm 94 translatable relative to brackets 93 and reversibly securable or affixable with regard to at least one bracket so as to advantageously position vacuum cups 66 in relation to the targeted minor panel $P_m$ of the case blank.

Rack plate 92 includes opposing surfaces, namely, a lower surface 96 adapted to support rack arm 94, and an upper surface 98 adapted to operatively receive picker plate 62, more particularly, lower surface 70 of picker plate 62. A periphery of rack plate 92 is adapted for operative union with rack servo 54, advantageously as shown, a peripheral edge portion 100 of rack plate 92 includes a toothed arcuate segment 102 for receipt of a geared shaft 55 (FIG. 7) of rack servo 54.

Upper surface 98 of rack plate 92 includes a series of spaced apart track followers 104 which reside within keyway or track 72 of lower surface 70 of picker plate 62 (see e.g., FIG. 4). Advantageously, but not necessarily, track followers 104 comprises discs as shown, more particularly, discs having a grooved circumferential surface 106, an upper portion 108 of upper and lower disc portions 108, 110 retained in/by keyway 72. Upon activation of rack servo 54 and the resulting travel imparted thereby to rack arm assembly 90, upper disc portions 108 slide within and/or in and out of keyway 72 based upon the amount of travel called for and the location of the given disc.

What has been described and illustrated herein are one or more preferred embodiments of the contemplated robotic case erector, along with some of its variations. It should be readily appreciated that the heretofore described assemblies, subassemblies and/or mechanism may be readily altered and/or adapted in keeping with the scope of the disclosed advantageous and desirable functionality. To wit, alternate structures or relationships between disclosed structures may be suitable selected to effectuate the contemplated centerless pivot and/or the contemplated separate functions of flap "breaking" and flap folding, including the "fit" of what is essentially a flap folding assembly relative to the other assemblies, subassemblies and or mechanisms of the case engaging apparatus. Moreover, the terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Finally, any headings utilized within the description are for convenience only and have no legal or limiting effect.

That which is claimed:

1. A case setup apparatus comprising:

a. a robotic arm characterized by first and second arm segments and three pivotable arm joints, a first arm joined J1 being an anchorable arm joint, a second arm joint J2 being an intermediate arm joint, and a third arm joint J3 being a distal arm joint;

b. a case blank engaging apparatus operatively supported by said robotic arm via J3 for two dimensional travel from a source of case blanks, said case engaging apparatus comprising:

i. a picker arm assembly for picking a case blank from the source of case blanks, a picker arm of said picker arm assembly fixedly supported within said case blank engaging apparatus;

ii. a rack arm assembly for attaching to a picked case blank, a rack arm of said rack arm assembly pivotably supported relative to said picker arm assembly within said case blank engaging apparatus; and, iii. a flap folding subassembly operably supported by said picker arm assembly for reversible travel parallel to said picker arm of said picker arm assembly, said flap folding subassembly including flap engaging members, a flap engaging member of said flap engaging members being forwardly extendable to disassociate adjacent flaps of a case blank in advance of folding a flap by said flap engaging members.

2. The case setup apparatus of claim 1 wherein said case engaging apparatus is further carried by said robotic arm for rotation.

3. The case setup apparatus of claim 1 wherein said case engaging apparatus downwardly extends from said robotic arm.

4. The case setup apparatus of claim 1 wherein said robotic arm is arranged for operation in a horizontal plane of the apparatus.

5. The case setup apparatus of claim 1 wherein said robotic arm comprises a selective compliance robot arm.

6. The case setup apparatus of claim 1 wherein said robotic arm comprises a selective compliance robot arm, a free end of said selective compliance robot arm extendable in either or both of a first direction corresponding to a direction of process flow and a second direction corresponding to a direction transverse to process flow.

7. The case setup apparatus of claim 1 wherein said flap folding subassembly includes an actuator, said actuator operatively linked to said forwardly extendable flap engaging member to reversibly extend same.

8. The case setup apparatus of claim 1 wherein said flap engaging members comprise a proximal flap engaging member and a distal flap engaging member, said forwardly extendable flap engaging member adjacent said proximal flap engaging member.

9. The case setup apparatus of claim 1 wherein said flap engaging members comprise a proximal flap engaging member, an intermediate flap engaging member, and a distal flap engaging member, said forwardly extendable flap engaging member intermediate said proximal and said intermediate flap engaging members.

10. The case setup apparatus of claim 1 wherein said flap engaging members comprise a proximal flap engaging member and a distal flap engaging member, said distal flap engaging member being width adjustable relative to said proximal flap engaging member.

11. The case setup apparatus of claim 1 wherein said flap engaging members comprise a proximal flap engaging member and a distal flap engaging member, said forwardly extendable flap engaging member adjacent said proximal flap engaging member, said distal flap engaging member being width adjustable relative to said proximal flap engaging member.

12. The case setup apparatus of claim 1 wherein said case engaging apparatus further comprises cooperatively united plates, said picker arm assembly depending from a first plate of said cooperatively united plates, said rack atm assembly depending from a second plate of said cooperatively united plates.

13. The case set up apparatus of claim 1 wherein said case engaging apparatus further comprises cooperatively united plates, said picker arm assembly depending from a first plate of said cooperatively united plates, said rack arm assembly depending from a second plate of said cooperatively united plates, said cooperatively united plates delimiting a centerless pivot locus for said case engaging apparatus.

14. The case set up apparatus of claim 1 wherein said case engaging assembly further comprises cooperatively united plates, said picker arm assembly depending from a first plate of said cooperatively united plates, said rack arm assembly depending from a second plate of said cooperatively united plates, said second plate driven for rotation relative to said first plate of said cooperatively united plates.

15. The case set up apparatus of claim 1 wherein said rack arm assembly pivots within a pivot range of 0-110 degrees.

16. The case set up apparatus of claim 1 wherein said rack arm assembly pivots throughout a pivot range of 0-110 degrees.

17. The case set up apparatus of claim 1 wherein said case engaging apparatus further comprises a rack arm driver, said rack arm assembly pivoted by said rack arm driver.

* * * * *